US006943746B2

(12) United States Patent
Talvitie et al.

(10) Patent No.: US 6,943,746 B2
(45) Date of Patent: Sep. 13, 2005

(54) RADIO DEVICE AND ANTENNA STRUCTURE

(75) Inventors: Olli Talvitie, Tampere (FI); Ilkka Pankinaho, Paimio (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/692,408

(22) Filed: Oct. 23, 2003

(65) Prior Publication Data

US 2004/0135729 A1 Jul. 15, 2004

(30) Foreign Application Priority Data

Oct. 24, 2002 (FI) ..... 20021897

(51) Int. Cl.[7] ..... H01Q 1/36; H01Q 1/38
(52) U.S. Cl. ..... 343/767; 343/700 MS
(58) Field of Search ..... 343/700 MS, 702, 343/767, 845, 846, 907

(56) References Cited

U.S. PATENT DOCUMENTS 6,346,914 B1 * 2/2002 Annamaa ..... 343/700 MS
6,380,905 B1 * 4/2002 Annamaa et al. ..... 343/767
6,381,471 B1 4/2002 Dvorkin ..... 455/552.1
6,448,932 B1 9/2002 Stoiljkovic et al. .. 343/700 MS
6,476,769 B1 * 11/2002 Lehtola ..... 343/702
6,597,317 B2 * 7/2003 Talvitie ..... 343/700 MS
6,774,850 B2 * 8/2004 Chen ..... 343/700 MS
2002/0089454 A1 7/2002 Eggleston et al. ..... 343/702
2003/0050032 A1 3/2003 Toshiyuki ..... 455/272

FOREIGN PATENT DOCUMENTS

EP 1 202 386 A2 5/2002
WO WO 01/65636 A1 9/2001
WO WO 02/05382 A1 1/2002
WO WO 02/078123 A1 10/2002

* cited by examiner

*Primary Examiner*—Don Wong
*Assistant Examiner*—Minh Dieu A

(57) ABSTRACT

A radio device and an antenna structure comprising a ground plane, at least a first and a second radiator, both radiators being configured to provide at least one resonance frequency in order to provide at least one frequency band. The antenna structure further comprises separate feed points for both radiators grounded to the ground plane. The first radiator is configured to provide at least two frequency bands, at least one of the frequency bands being at least partly overlapping with at least one frequency band provided by the second radiator. In addition, at least the first radiator is a groove plane antenna such that coupling of the radiators with each other at least within the partly overlapping frequency range is substantially avoided.

17 Claims, 4 Drawing Sheets

RADIO DEVICE AND ANTENNA STRUCTURE

FIELD OF THE INVENTION

The invention relates to antenna structures, and particularly to internal antennas used in radio devices, such as mobile stations.

BACKGROUND OF THE INVENTION

As wireless communication becomes increasingly common, more new frequency ranges are needed for different wireless systems. Meanwhile the demand for wireless terminal equipment, such as mobile stations, supporting several wireless systems is also on the increase. The most recent mobile station models typically employ several of the following systems and frequency ranges: EGSM 900 (880 to 960 MHz), GSM 1800 (1710 to 1880 MHz), GSM 1900 (1850 to 1990 MHz), WCDMA 2000 (1920 to 2170 MHz), US-GSM 850 (824 to 894 MHz), US-WCDMA 1900 (1850 to 1990 MHz) and US-WCDMA 1700/2100 (Tx 1710 to 1770 MHz, Rx 2110 to 2170 MHz). GSM 1900 and some WCDMA frequency ranges, for example, then at least partly overlap.

In small radio devices, such as mobile stations, the aim has often been to implement transmission and reception in all systems and frequency ranges by means of a single antenna. The small radio devices provide little space, so it would often be justifiable to use only one antenna. In such a case, however, different frequency ranges have to be combined to a common antenna by means of a lossy switch. The problem is particularly serious in connection with a WCDMA system wherein the use of a single antenna both for transmitting and receiving requires a duplex filter since transmission and reception take place simultaneously. In US-WCDMA 1900, for example, the duplex separation of the frequencies between transmission and reception is very small, so due to the strict filtering requirements, a duplex filter with as small losses as possible, such as a ceramic duplexer, has to be used. Such a duplex filter is considerably large and, in addition, it is typically advantageously installed underneath an antenna, which means that the antenna is provided with little space and the radiation efficiency of the antenna drops.

Therefore, both for the size of a mobile station and minimization of losses, it would be more advantageous to use an antenna structure comprising two antennas and to divide the transmission and reception e.g. in the WCDMA system between different antennas. This would enable the large, loss-incurring duplex filter to be avoided and replaced by simpler band-pass filters.

In such a solution, a problem is presented by the above-mentioned overlapping frequency ranges wherein simultaneous transmission and reception take place. The two antennas, or more precisely two radiators, provided in the single antenna structure and operating at least partly within the same frequency range couple strongly with each other during use. This means that when power is fed to a first radiator, some of this power transfers to a second radiator, which impairs the radiation power of both radiators and causes additional power consumption for the mobile station. In other words, isolation between the two antennas, i.e. radiators, is insufficient, typically of the order of less than 10 dB.

The applicant's earlier European Patent application 1 202 386 discloses a planar antenna structure for a radio device, wherein a planar radiator comprises at least one electrically non-conductive groove to enable the planar radiator to be divided into at least two parts, the frequency ranges provided by the two parts preferably being different. Such an antenna structure is advantageous e.g. in multifrequency mobile stations, but it cannot be used without losses for simultaneous transmission and reception taking place within the same frequency range; neither can the isolation problem described above be solved by such a structure alone.

BRIEF SUMMARY OF THE INVENTION

An object of the invention is thus to provide an improved antenna structure so as to enable at least some of the above-mentioned problems to be alleviated. The object of the invention is achieved by an antenna structure and a radio device which are characterized by what has been disclosed in the independent claims.

Preferred embodiments are disclosed in the dependent claims.

The invention is based on the unexpected discovery that when an antenna structure comprising two radiators matched for at least partly the same frequency range is used, at least one of the radiators being the above-mentioned groove plane antenna matched for several frequency ranges, considerable isolation is provided between the radiators. Such an antenna structure thus comprises at least one ground plane, at least a first and a second radiator located at a distance from the ground plane, both radiators being configured to provide at least one resonance frequency in order to provide at least one frequency band, and an isolating layer between the ground plane and the radiators.

The antenna structure further comprises separate feed points for the at least two radiators, the radiators are grounded by a ground point to at least some ground plane, and at least the first radiator is a groove plane antenna configured to provide at least two frequency bands, preferably at least one lower frequency band and at least one higher frequency band, at least one of the frequency bands being at least partly overlapping with at least one frequency band provided by the second radiator. The use of such a groove plane antenna in the above-described antenna structure results in extremely strong isolation between the radiators such that coupling of the radiators with each other at least within the partly overlapping frequency range is substantially avoided.

According to measurement results, the isolation between the radiators at least within the partly overlapping frequency range is substantially more than 10 dB, preferably more than 20 dB.

A radio device according to an embodiment comprises the above-described antenna structure for delivering a radio-frequency signal, whereby in the radio device, simultaneous transmission and reception of radio-frequency signals taking place at least within the partly overlapping frequency range are differentiated between the first and the second radiator.

Furthermore, in the above-described antenna structure, polarizations between the radiators are substantially orthogonal such that the diversity ratio between the radiators at least within the partly overlapping frequency range is substantially close to zero. According to a preferred embodiment, the above-described antenna structure can then be utilized for implementing diversity reception in a radio device comprising the above-described antenna structure for delivering a radio-frequency signal, whereby simultaneous reception of radio-frequency signals taking place at least within the partly overlapping frequency range is configured to be carried out as diversity reception by means of the first and the second radiator.

The invention provides considerable advantages. An advantage of the antenna structure of the invention is that the isolation between the radiators is considerably strong, which means that little or no power loss occurs from one radiator to another. However, the radiation power of the radiators is extremely good even within the overlapping frequency range. A radio device utilizing the antenna structure of the invention provides the advantage that the simultaneous transmission and reception of radio-frequency signals taking place within the overlapping frequency range can be differentiated between different radiators, which enables a smaller structure and smaller power consumption. On the other hand, an advantage of the antenna structure is that since the diversity ratio between the radiators at least within the partly overlapping frequency range is extremely small, the antenna structure preferably enables diversity reception to be implemented. An advantage of a preferred embodiment is that a duplex filter of a radio device supporting a WCDMA system in particular can be replaced by a simpler solution which also incurs smaller losses.

BRIEF DESCRIPTION OF THE DRAWINGS

The invention is now described in closer detail in connection with the preferred embodiments and with reference to the accompanying drawings, in which.

DETAILED DESCRIPTION OF THE INVENTION

Figure 1:
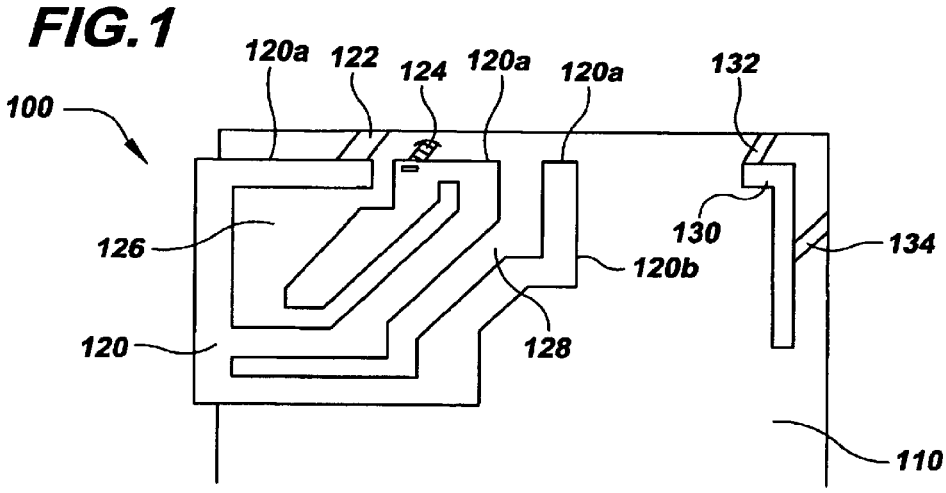
FIG. 1 shows an antenna structure according to a preferred embodiment.

Referring to FIG. 1, a preferred embodiment will be described in the following. FIG. 1 shows a planar antenna structure called a PIFA (Planar Inverted F Antenna) antenna structure 100 comprising a ground plane 110, a first radiator 120 and a second radiator 130. The radiators 120, 130 are located at a distance from the ground plane 110 such that air or another dielectric material is, as an isolating material, provided between the ground plane 110 and the radiators 120, 130. The first radiator 120 is a "groove plane antenna" which is connected to the ground plane 110 by a ground point 122 and to which radiation power is fed from a feed point 124. The ground point 122 constituting a grounding line is located substantially at the edge of the radiator 120. The feed point 124 can be implemented as coaxial feed e.g. as a lead-through from the ground plane such that it resides at a substantial distance from the edge of the radiator. The feed point 124 can also be implemented by placing it at the edge of the radiator 120, in a similar manner to that of the ground point.

The planar radiator 120 is provided with a first groove 126 and a second groove 128, which are sections containing no electrically conductive material. Such a groove plane antenna structure is suitable for use in more than one frequency range. An open end of the first groove 126 resides at the edge 120*a* of the radiator 120, between the ground point 122 and the feed point 124. An open end of the second groove 128 resides at the edge 120*a* of the radiator, between the feed point 124 and the edge 120*b*. The second groove 128 is to produce a lower frequency range by separating a right-hand branch from the radiator, whereas the first groove 126 residing between the ground point 122 and the feed point 124 further divides the radiator 120 into two different branches, i.e. an element facing the ground point and an element facing the feed point, which are responsible for producing the higher frequency ranges. In order for the groove plane antenna to operate as desired, the first groove 126 is placed in the radiator between the ground point 122 and the feed point 124 such that a line segment provided between the ground point 122 and the feed point 124 intersects with the first groove 126, whereby a smaller portion of the groove 126 is provided on the side of the open end of the groove 126 of the particular line segment, i.e. on the side of the edge 120*a*. The proportion of the smaller portion of the first groove 126 of the surface area of the entire groove 126 is typically of the order of few percentages at its maximum.

The characteristics of a groove plane antenna can be designed as desired by changing the dimensions of the radiator 120, e.g. by changing the shape, length and width of the grooves and/or by changing the location of the feed or ground point; such changes always affect the resonance frequencies and the radiation power produced by the radiator. As to the present embodiment, the point is that the groove plane antenna is configured to radiate at least within one lower frequency range and within one or more higher frequency ranges. In connection with the present application, frequencies substantially slightly below 1 GHz (approximately 800 to 1000 MHz) are regarded as lower frequency ranges while frequencies substantially of 2 GHz (approximately 1700 to 2200 MHz) are regarded as higher frequency ranges; these frequency ranges are usually used by different mobile communication systems. However, the antenna structure of the present embodiments is not restricted to these frequencies only but it can also be applied to other, particularly substantially over 2 GHz, frequencies. European Patent application 1 202 386 discusses the implementation of a groove plane antenna and details relating to different embodiments thereof in closer detail.

The second radiator 130 is a narrow, planar radiator whose surface area in this embodiment is substantially smaller than that of the first radiator 120. The second radiator 130 also comprises a ground point 132 connecting the radiator 130 to a ground plane 110, and a feed point 134 feeding radiation power. The ground point 132 constituting a grounding line is located substantially at the edge of the radiator 130. The feed point 134 can be implemented as coaxial feed e.g. as a lead-through from the ground plane such that it resides at a substantial distance from the edge of the radiator. The feed point 134 can also be implemented by placing it at the edge of the radiator 130, in a similar manner to that of the ground point. The second radiator is configured to radiate within a frequency range at least partly overlapping with at least one frequency range, preferably with a higher frequency range, of the first radiator. As far as the operation of the present embodiments is concerned, the shape or location of the second radiator 130 with respect to the first radiator 120 is irrelevant; the only point is that both radiators are provided with a feed point of their own and, preferably but not necessarily, a common ground plane.

The antenna structure of FIG. 1 can preferably be configured to operate as an antenna structure for a multifrequency mobile station. An example of a multifrequency mobile station is a mobile station configured to support EGSM 900 (880 to 960 MHz), GSM 1900 (1850 to 1990 MHz), WCDMA 2000 (1920 to 2170 MHz) systems and frequency ranges. The GSM 1900 and WCDMA 2000 frequency ranges then partly overlap. A similar situation occurs in a mobile station employing the US-WCDMA 1900 (1850 to 1990 MHz) and GSM 1900 (1850 to 1990 MHz) frequency ranges or US-WCDMA 1700/2100 (Tx 1710 to 1770 MHz, Rx 2110 to 2170 MHz) and GSM 1800, (1710 to 1880 MHz) systems. As discussed above, both for the size of the mobile station and minimization of losses, in such a mobile station it is advantageous to use an antenna structure comprising two antennas and to divide the transmission and reception in the WCDMA system between different antennas. This enables the large, loss-incurring duplex filter to be avoided and replaced by two simpler low-loss filters which, depending on the situation, can be low-pass, high-pass or band-pass filters.

Figure 2:
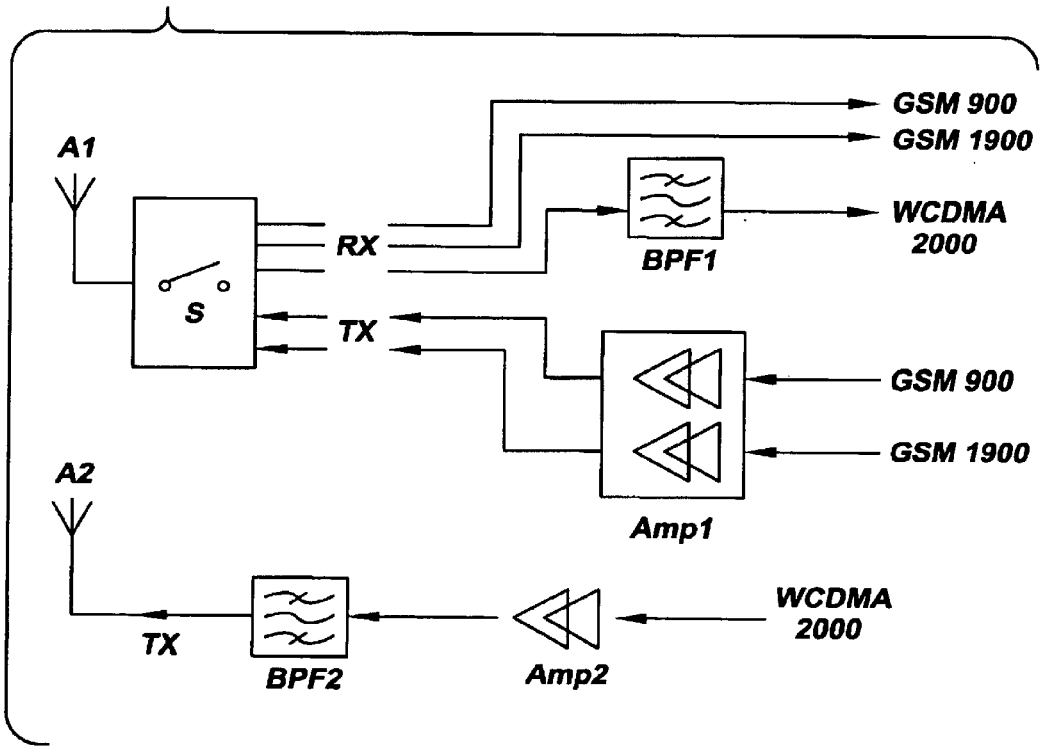
FIG. 2 is a block diagram showing the front end of transmission and reception according to a preferred embodiment.

This enables e.g. the antenna configuration of FIG. 2 to be used. In the block diagram of FIG. 2, an antenna A1 corresponds with the first radiator 120 of FIG. 1 and, similarly, an antenna A2 corresponds with the second radiator 130 of FIG. 1. Via a switch S, the antenna A1 is configured to receive (RX) data transmission according to all above-mentioned systems. In addition, via the switch S, the antenna A1 is configured to transmit (TX) signals amplified by an amplifier block Amp1 at both GSM frequencies, i.e. EGSM 900 and GSM 1900. When a mobile station uses either of the GSM frequency ranges, the switch S is used for controlling the time-divisionally occurring alternation of transmission and reception within the particular frequency range. If, on the other hand, a WCDMA 2000 system is used, the switch S is shut off at all times and a received signal is filtered to a correct frequency band by means of a band-pass filter BPF1. The antenna A2 is configured only to transmit a WCDMA 2000 signal to be fed via an amplifier Amp2 and a band-pass filter BPF2. The transmission and reception in the WCDMA 2000 system have thus been divided between different antennas.

As stated above, the characteristics of a groove plane antenna can be designed as desired by changing the dimensions of a radiator, such changes always affecting the resonance frequencies and the radiation power produced by the radiator. If the antenna structure of FIG. 1 is arranged in the configuration of FIG. 2 so as to optimize the radiation characteristics of the antennas with respect to the frequency bands being used, matchings according to FIG. 3*a* and radiation efficiencies according to FIG. 3*b* will result for the radiators 120 and 130. Radiation efficiency refers to the efficiency of a radiator wherein the matching of the radiator has been taken into account.

Figure 3A:
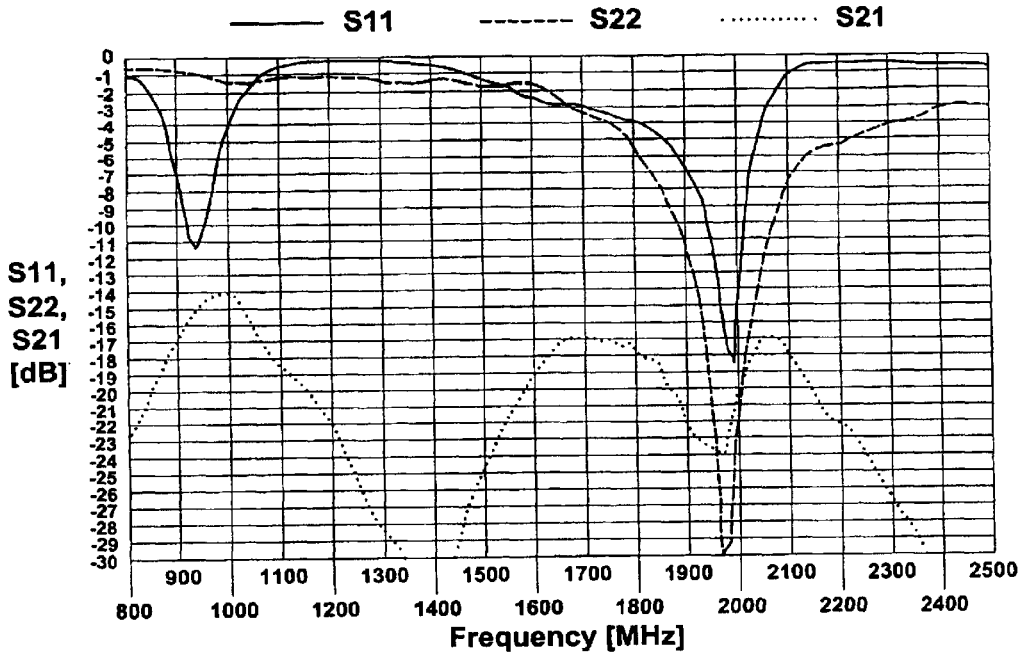
FIGS. 3*a* and 3*b* show frequency characteristics of radiators of the antenna structure of FIG. 1 arranged in the arrangement of FIG. 2.
Figure 3B:
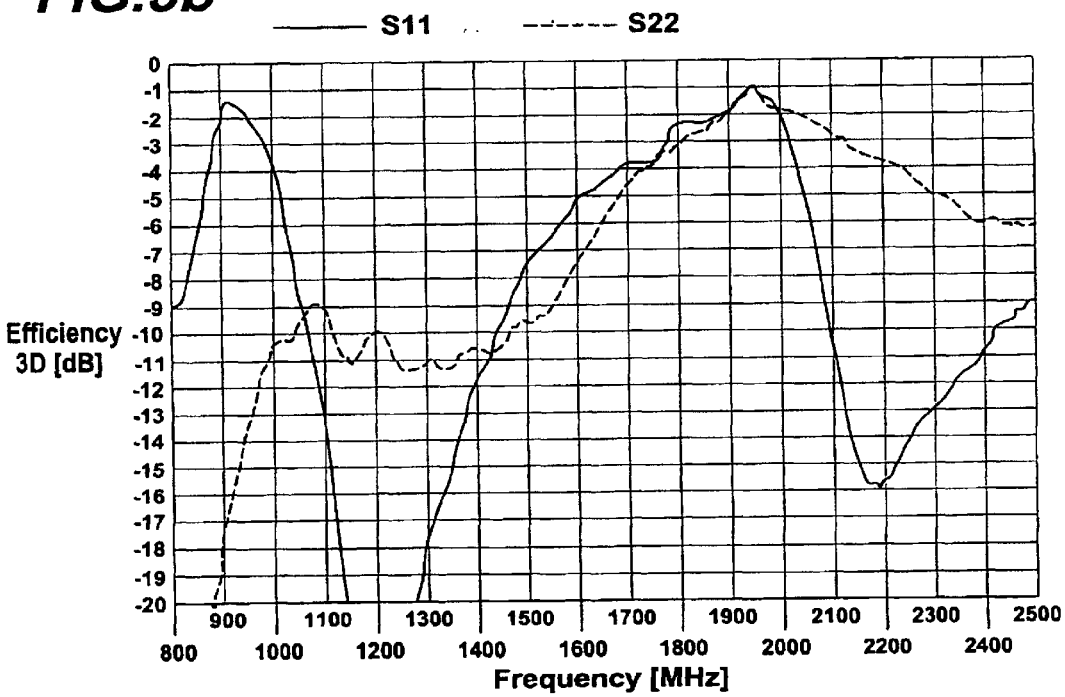

In FIG. 3*a*, the matching of the first radiator 120 is designated by a graph S11 and the matching of the second radiator 130 is designated by a graph S22. As can be seen in FIG. 3*a*, a first matching (lower frequency range) of the first radiator 120 substantially resides within a frequency range of 900 to 1000 MHz, the peak settling at a value of approximately 930 MHz. Furthermore, a second matching (higher frequency range) of the first radiator 120 resides substantially within a frequency range of 1900 to 2020 MHz, the peak settling at a value of approximately 1980 MHz. The second radiator 130 is configured substantially within a frequency range of 1800 to 2100 MHz, the peak settling at a value of approximately 1960 MHz. It can be seen in FIG. 3*b* that when considered with a 50% efficiency (−3 dB), the frequency bands of the first radiator 120 settle within ranges of approximately 880 to 980 MHz and 1820 to 2030 MHz. Similarly, the frequency band of the second radiator 130 settles within a range of approximately 1780 to 2120 MHz. The second matching range and the higher frequency band of the first radiator 120 thus substantially overlap with the matching range and the frequency band of the second radiator 130.

As far as the antenna structure of the present embodiments is concerned, the important point is, however, the isolation between the radiators 120 and 130, which is designated by a graph S21 in FIG. 3*a*. This shows that within the overlapping frequency range of 1920 to 1990 MHz of the GSM 1900 and WCDMA 2000 and around this frequency range, the isolation between the radiators 120 and 130 is substantially more than 20 dB. In other words, the isolation is extremely strong, which means that power transfer, i.e. loss, from one radiator to another is minimal. This, again, preferably cuts down power consumption and thermal losses, as well as increases the operation time for a mobile station.

Figure 4:
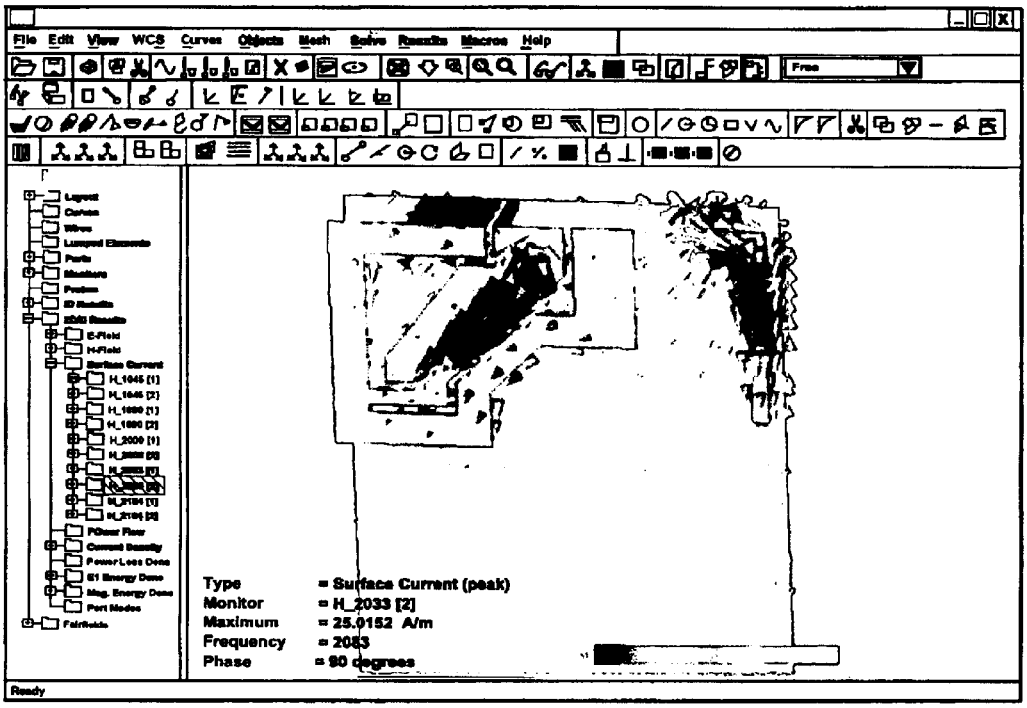
FIG. 4 shows a simulated current distribution of the antenna structure of FIG. 1.

FIG. 4 shows a simulated current distribution of the antenna structure of FIG. 1 when a WCDMA antenna (radiator 130) is active at a frequency of 2083 MHz. A GSM/WCDMA antenna (radiator 120) is passive; it neither transmits nor receives signals. Due to the active WCDMA antenna (radiator 130), current is induced to the GSM/WCDMA antenna (radiator 120) around the closed end of the first groove 126. The currents, however, have opposite directions (arrows in opposite directions), which means that they cancel each other out. In such a case, practically no power at all propagates to the radiator 120 from the radiator 130, which enables extremely strong isolation to be achieved between the radiators 120 and 130. As far as the generation of strong isolation is concerned, the shape and location of the second radiator 130 with respect to the first radiator 120 is irrelevant; the point is that both radiators are provided with a feed point of their own and that the second radiator is configured to radiate within a frequency range at least partly overlapping with at least one higher frequency range of the first radiator.

The current distribution of FIG. 4 illustrates the basic inventive idea: when an antenna structure is used wherein two radiators are coupled to the same ground plane and wherein the radiators have feed points of their own and are configured to radiate at least within partly the same frequency range and wherein at least one of the radiators is a groove plane antenna, substantially strong isolation is provided between the radiators. The operating range and matching of a groove plane antenna can be adjusted by modifying different dimensions of the groove plane antenna; this is described e.g. in European Patent Application 1 202 386. However, as far as the implementation of the present embodiments is concerned, the point is that the groove plane antenna is configured to radiate at least within two frequency ranges, one range, preferably a higher frequency range, being at least partly within the same frequency range as the frequency range of the second radiator. The strong isolation provided between the radiators can thus be utilized e.g. in the antenna configuration described in FIG. 2 which, in turn, enables the implementation of a mobile station to be advantageously simplified and power to be saved.

As becomes apparent from the above-mentioned basic inventive idea, the invention is not restricted to the antenna structure of FIG. 1 only, but a similar isolation phenomenon occurs in all antenna structures fulfilling the above-mentioned requirements. Consequently, the antenna structure can be implemented e.g. such that both radiators are groove plane antennas. This can be implemented e.g. as an antenna structure otherwise similar to the above-described antenna structures except for the second radiator being replaced by a groove plane antenna. By providing both groove plane antennas with a structure which enables the desired frequency ranges to be achieved, it can be shown that within the overlapping frequency ranges, the isolation between the groove plane antennas is substantially more than 20 dB, which results in minimal power transfer, i.e. loss, from one radiator to another.

In the above-described examples, the antenna structure of the present embodiments is utilized by implementing both transmission and reception of GSM frequencies and WCDMA reception by one antenna while another antenna is used for WCDMA transmission only. The invention is not, however, restricted to such a configuration but as far as most antenna configurations according to the embodiments are concerned, the only point is that the simultaneously occurring transmission and reception are differentiated between different antennas, in which case the advantageous antenna structure enables sufficient isolation to be achieved between a transmitting and a receiving antenna.

Figure 5A:
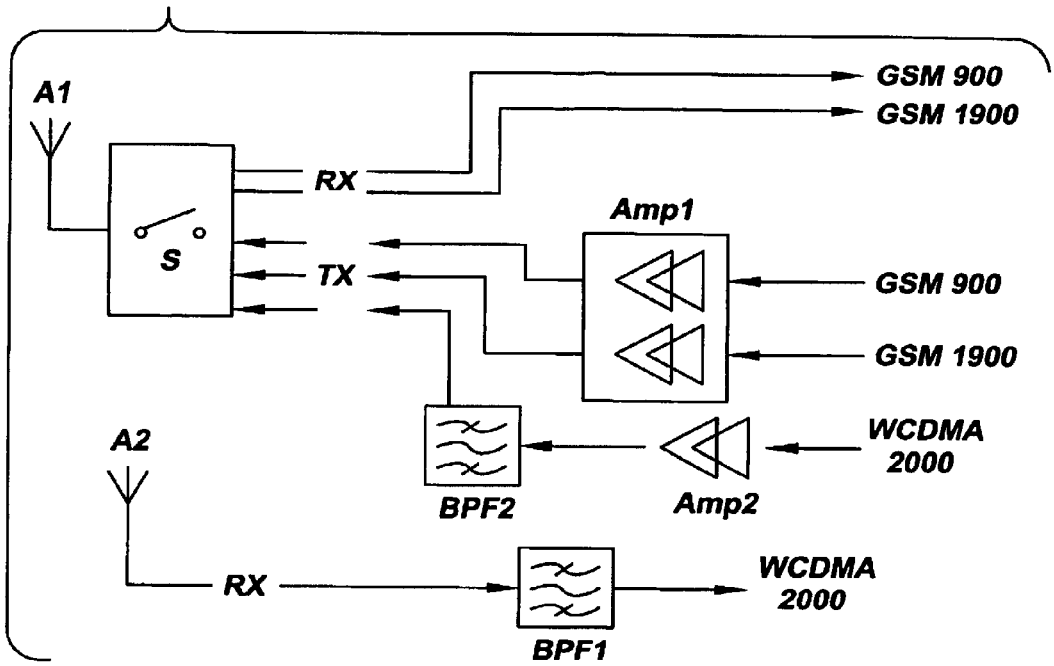
FIGS. 5*a* and 5*b* are block diagrams showing the front end of transmission and reception according to some preferred embodiments.

Consequently, the embodiment of FIG. 5*a*, for example, can be used as an antenna configuration, wherein the configuration is otherwise similar to that of FIG. 2 with the exception that WCDMA transmission and WCDMA reception have traded places. Also in this configuration, when the mobile station uses either of the GSM frequency ranges, a switch S is used for controlling the alternation of transmission and reception taking place time-divisionally within the particular frequency range. When the WCDMA 2000 system is used, the switch S is shut off at all times, and a WCDMA 2000 signal amplified by an amplifier Amp2 and filtered to a correct frequency range via a band-pass filter BPF2 is transmitted. An antenna A2 is configured only to receive a received signal filtered by a band-pass filter BPF1. Also in this configuration, the transmission and reception in the WCDMA 2000 system are divided between different antennas.

Figure 5B:
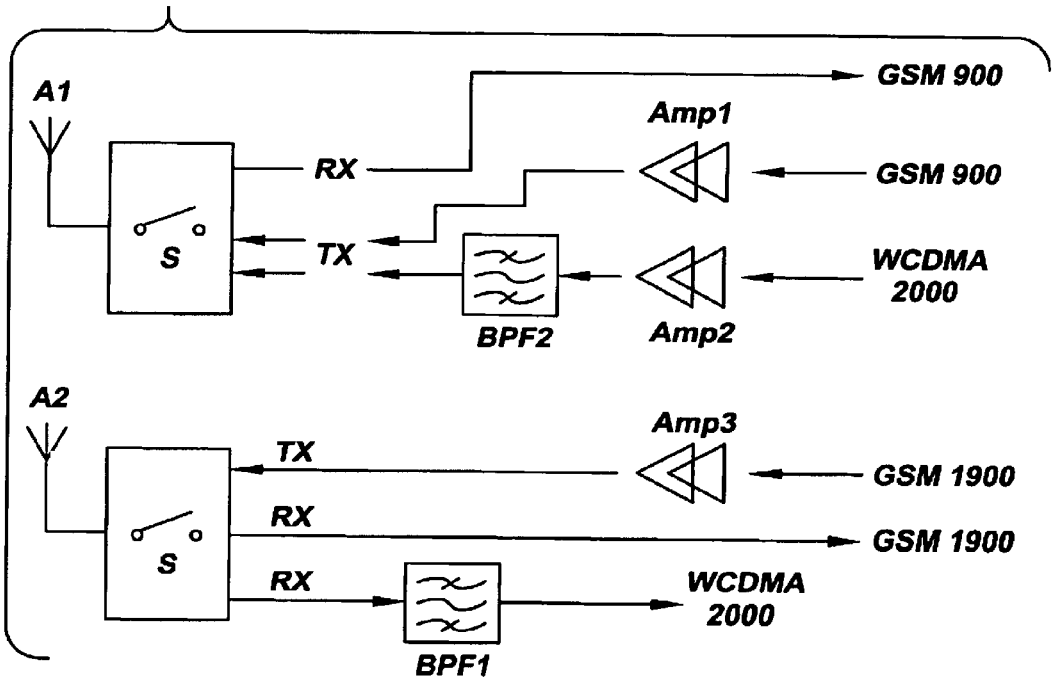

Furthermore, the invention is not restricted to antenna configurations wherein a second antenna A2 operates as a WCDMA transmission or reception antenna only but e.g. some of the GSM functions can be configured in the second antenna A2. Consequently, the embodiment of FIG. 5*b*, for example, can be used as an antenna configuration, wherein the functions of the GSM 1900 system (transmission and reception) are moved to the second antenna A2 together with the WCDMA 2000 system reception. In such a case, a switch S should also be provided in connection with the second antenna A2 to control the transmission and reception of the system used, as described above.

It is also possible to configure all GSM functionalities in one antenna A1 and, similarly, all WCDMA functionalities (transmission and reception) in another antenna A2 by means of a duplex filter. Naturally, no advantage of avoiding the use of a duplex filter is then provided but nevertheless, the strong isolation between the antennas reduces power losses between the antennas in such a configuration as well; this, again, preferably cuts down thermal losses and power consumption of the mobile station.

Furthermore, according to an embodiment, the disclosed antenna structure can also be utilized in diversity reception wherein multipath-propagated signals are received via several antenna branches, which enables both the noise of a combined signal and interference caused by fades and interference to be reduced. Reception can then be carried out also using a lower-powered signal, which, in turn, increases the user capacity of the system. Furthermore, a higher-quality received signal enables the data rate to be increased. Diversity reception has typically been used in base station reception since in the known antenna solutions for mobile stations, the isolation and diversity ratio between antennas are typically poor, which means that the potential gain obtained from the diversity reception in order to strengthen the signals has also been minimal. Instead, in the presently disclosed antenna structure, the isolation between antennas is considerably strong whereas the diversity ratio is considerably small, which enables the antenna structure to be efficiently utilized also in the diversity reception of mobile stations.

For example, polarizations between the first and the second radiator of the antenna structure of FIG. 1 are almost orthogonal. The diversity ratio between the radiators is then also very small. At a frequency of 1950 MHz, for example, wherein the efficiency of the first radiator is substantially 50% and the efficiency of the second radiator substantially 75%, the diversity ratio between the radiators is substantially 0.02. Such a structure is thus extremely well suited to be utilized in diversity reception.

Figure 6:
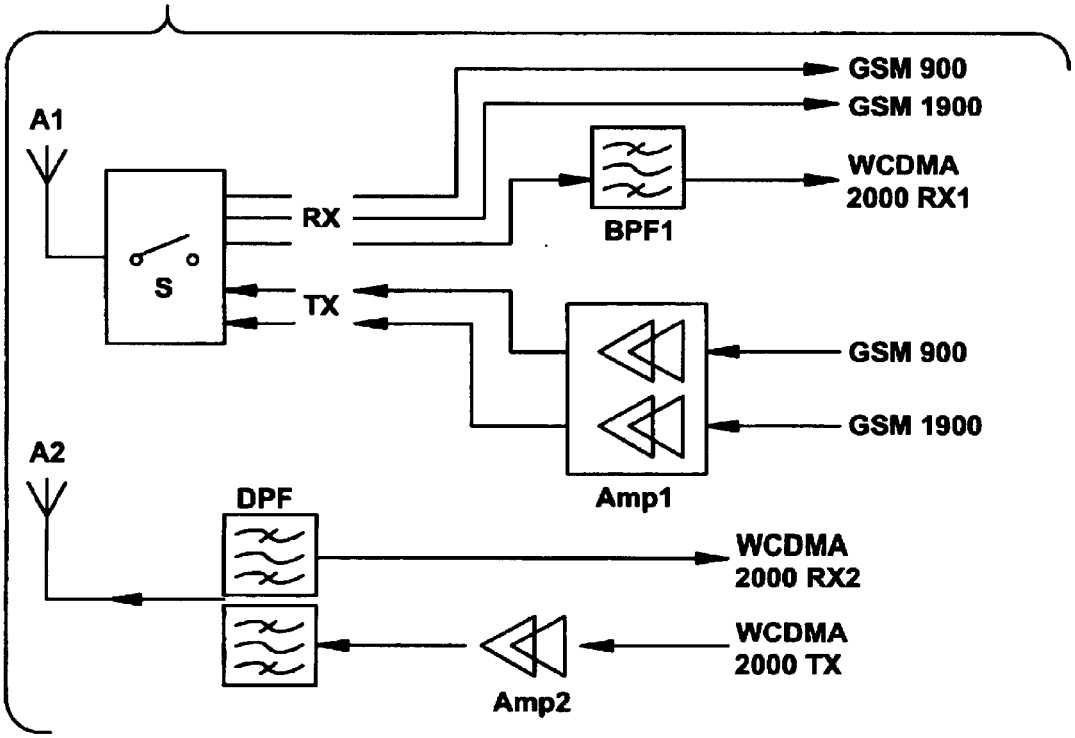
FIG. 6 shows a diversity reception arrangement according to a preferred embodiment.

FIG. 6 is a block diagram showing a preferred embodiment for implementing diversity reception. In the block diagram of FIG. 6, an antenna A1 corresponds with the first radiator 120 of FIG. 1 and, similarly, an antenna A2 corresponds with the second radiator 130 of FIG. 1. Via a switch S, the antenna A1 is configured to receive (RX) data transmission according to both GSM frequencies. In addition, via the switch S, the antenna A1 is configured to transmit (TX) signals amplified by an amplifier block Amp1 at both GSM frequencies, i.e. EGSM 900 and GSM 1900. Furthermore, the antenna A1 operates as a first diversity branch (RX1) in the reception of the WCDMA 2000 system, which is primarily responsible for the WCDMA 2000 reception. When a mobile station uses either of the GSM frequency ranges, the switch S is used for controlling the time-divisionally occurring alternation of transmission and reception within the particular frequency range. If, on the other hand, the WCDMA 2000 system is used, the switch S is shut off at all times and a received signal is filtered to a correct frequency band by means of a band-pass filter BPF1.

The antenna A2 is configured to transmit a WCDMA 2000 signal to be fed via an amplifier Amp2. In addition, the antenna A2 operates as a second diversity branch (RX1) in the reception of the WCDMA 2000 system, which is secondarily responsible for the WCDMA 2000 reception. Since the antenna A2 is configured both for the transmission and reception of the WCDMA 2000 system, a duplex filter DPF is required between a transmitting branch and a receiving branch. The characteristics of this duplex filter are not, however, nearly as critical as if all the functionalities (RX/TX) of the WCDMA 2000 system were provided in the antenna A2. The diversity reception can thus be preferably implemented using a smaller duplex filter having less sophisticated filtering characteristics while at the same time it is possible to achieve the above-described advantages of diversity reception. Diversity reception can also be preferably implemented in the GSM system, in which case the GSM reception takes place via both antennas A1 and A2.

For illustrative reasons, different GSM and WCDMA systems have been used as examples in the above embodiments that can preferably be applied in connection with the antenna structure of the invention. However, it is obvious for one skilled in the art that the considerably strong isolation achieved by the antenna structure of the invention can also be utilized in connection with any other wireless data transfer wherein transmission and reception take place simultaneously substantially within the same or adjacent frequency ranges. Consequently, the antenna structure of the invention can preferably be applied e.g. to a wireless local area network system IEEE 802.11b utilizing spread spectrum technology and to a wireless Bluetooth system utilizing time division technology, both operating within a frequency range of 2400 to 2483.5 MHz. Despite the overlapping nature of the frequency ranges, both systems can preferably be coupled to the antenna structure of the invention. Furthermore, strong isolation is to be provided between an antenna used for GPS satellite positioning and antennas of different cellular mobile communication systems although the frequency range of the GPS system (1227/1575 MHz) does not overlap with the commonly used cellular mobile communication systems.

It is obvious to one skilled in the art that as technology advances, the basic idea of the invention can be implemented in many different ways. The invention and its embodiments are thus not restricted to the above-described examples but may vary within the scope of the claims.

What is claimed is:

1. An antenna structure comprising:

at least one ground plane, at least a first and a second radiator located at a distance from the ground plane and grounded by a ground point to the ground plane, both radiators being configured to provide at least one resonance frequency in order to provide at least one frequency band, and an isolating layer between the ground plane and the radiators, separate feed points for the at least two radiators, in which antenna structure at least the first radiator is configured to provide at least two frequency bands, at least one of the frequency bands being at least partly overlapping with at least one frequency band provided by the second radiator, and at least the first radiator is a groove plane antenna such that coupling of the radiators with each other at least within the partly overlapping frequency range is substantially avoided.

2. An antenna structure as claimed in claim 1, wherein isolation between the radiators at least within the partly overlapping frequency range is substantially more than 10 dB, preferably more than 20 dB.

3. An antenna structure as claimed in claim 1, wherein polarizations between the radiators are substantially orthogonal such that the diversity ratio between the radiators at least within the partly overlapping frequency range is substantially almost zero.

4. An antenna structure as claimed in claim 1, wherein the first radiator is configured to provide at least three frequency bands, comprising at least one lower frequency band and at least two higher frequency bands.

5. An antenna structure as claimed in claim 1, wherein at least one higher frequency band of the first radiator is configured to at least partly overlap with at least one frequency band provided by the second radiator.

6. A radio device comprising an antenna structure for delivering a radio-frequency signal, the antenna structure comprising at least one ground plane, at least a first and a second radiator located at a distance from the ground plane and grounded by a ground point to the ground plane, both radiators being configured to provide at least one resonance frequency in order to provide at least one frequency band, and an isolating layer between the ground plane and the radiators, separate feed points for the at least two radiators, in which antenna structure at least the first radiator is configured to provide at least two frequency bands, at least one of the frequency bands being at least partly overlapping with at least one frequency band provided by the second radiator, and at least the first radiator is a groove plane antenna such that coupling of the radiators with each other at least within the partly overlapping frequency range is substantially avoided, and simultaneous transmission and reception of radio-frequency signals taking place at least within the partly overlapping frequency range are differentiated between the first and the second radiator.

7. A radio device as claimed in claim 6, wherein the radio-frequency signals being simultaneously transmitted and received at least within the partly overlapping frequency range are configured to be filtered by a band-pass filter, a high-pass filter or a low-pass filter.

8. A radio device as claimed in claim 6, wherein the first radiator is configured to transmit and receive a time-divisional radio-frequency signal, such as a GSM signal, and to receive a frequency-divisional radio-frequency signal, such as a WCDMA signal, and the second radiator is configured to transmit a frequency-divisional radio-frequency signal, such as a WCDMA signal.

9. A radio device as claimed in claim 8, wherein also the second radiator is configured to transmit and receive a time-divisional radio-frequency signal, such as a GSM signal.

10. A radio device as claimed in claim 6, wherein the first radiator is configured to transmit and receive a time-divisional radio-frequency signal, such as a GSM signal, and transmit a frequency-divisional radio-frequency signal, such as a WCDMA signal, and the second radiator is configured to receive a frequency-divisional radio-frequency signal, such as a WCDMA signal.

11. A radio device as claimed in claim 10, wherein also the second radiator is configured to transmit and receive a time-divisional radio-frequency signal, such as a GSM signal.

12. A radio device as claimed in claim 6, wherein the radio device comprises coupling means for coupling the transmission and reception of the time-divisional radio-frequency signal and the frequency-divisional radio-frequency signal.

13. A radio device as claimed in claim 6, wherein polarizations between the radiators are substantially orthogonal such that the diversity ratio between the radiators at least within the partly overlapping frequency range is substantially almost zero.

14. A radio device as claimed in claim 6, wherein the radio device is a mobile station wherein at least one of the following is configured to be the system supported by the mobile station and the frequency bands of the radiators: EGSM 900 (880 to 960 MHz), GSM 1800 (1710 to 1880 MHz), GSM 1900 (1850 to 1990 MHz), WCDMA 2000 (1920 to 2170 MHz), US-GSM 850

(824 to 894 MHz), US-WCDMA 1900 (1850 to 1990 MHz) and US-WCDMA 1700/2100 (Tx 1710 to 1770 MHz, Rx 2110 to 2170 MHz).

15. A radio device comprising an antenna structure for delivering a radio-frequency signal, the antenna structure comprising at least one ground plane, at least a first and a second radiator located at a distance from the ground plane and grounded by a ground point to the ground plane, both radiators being configured to provide at least one resonance frequency in order to provide at least one frequency band, and an isolating layer between the ground plane and the radiators, separate feed points for the at least two radiators, in which antenna structure at least the first radiator is configured to provide at least two frequency bands, at least one of the frequency bands being at least partly overlapping with at least one frequency band provided by the second radiator, and at least the first radiator is a groove plane antenna such that coupling of the radiators with each other at least within the partly overlapping frequency range is substantially avoided, and simultaneous reception of radio-frequency signals taking place at least within the partly overlapping frequency range is configured to be carried out as diversity reception by means of the first and the second radiator.

16. A radio device as claimed in claim 15, wherein polarizations between the radiators are substantially orthogonal such that the diversity ratio between the radiators at least within the partly overlapping frequency range is substantially almost zero.

17. A radio device as claimed in claim 15, wherein the radio device is a mobile station wherein at least one of the following is configured to be the system supported by the mobile station and the frequency bands of the radiators: EGSM 900 (880 to 960 MHz), GSM 1800 (1710 to 1880 MHz), GSM 1900 (1850 to 1990 MHz), WCDMA 2000 (1920 to 2170 MHz), US-GSM 850 (824 to 894 MHz), US-WCDMA 1900 (1850 to 1990 MHz) and US-WCDMA 1700/2100 (Tx 1710 to 1770 MHz, Rx 2110 to 2170 MHz).

* * * * *